US007228591B2

(12) United States Patent
Bosses

(10) Patent No.: US 7,228,591 B2
(45) Date of Patent: Jun. 12, 2007

(54) EXTRACTOR INCLUDING SONIC AGITATOR

(76) Inventor: Mark D. Bosses, 505 NE. Spanish Trail, Boca Raton, FL (US) 33432

( * ) Notice: Subject to any disclaimer, the term of this patent is extended or adjusted under 35 U.S.C. 154(b) by 65 days.

(21) Appl. No.: 11/157,589

(22) Filed: Jun. 21, 2005

(65) Prior Publication Data

US 2006/0075596 A1 Apr. 13, 2006

Related U.S. Application Data

(63) Continuation-in-part of application No. 10/962,107, filed on Oct. 8, 2004.

(51) Int. Cl.
*A47L 11/30* (2006.01)
*A47L 9/04* (2006.01)

(52) U.S. Cl. ..... 15/320; 15/364; 15/382

(58) Field of Classification Search ..... 15/320–322, 15/363, 364, 382–384
See application file for complete search history.

(56) References Cited

U.S. PATENT DOCUMENTS

| | | | | |
|---|---|---|---|---|
| 2,253,309 | A * | 8/1941 | Smellie | 15/332 |
| 3,089,790 | A * | 5/1963 | Balamuth et al. | 134/1 |
| 4,307,484 | A * | 12/1981 | Williams | 15/321 |
| 4,756,048 | A * | 7/1988 | Kauffeldt et al. | 15/320 |
| 5,400,466 | A | 3/1995 | Alderman et al. | |
| 5,761,763 | A | 6/1998 | McAllise et al. | |
| 5,867,857 | A | 2/1999 | Crouser et al. | |
| 5,983,442 | A | 11/1999 | Louis et al. | |
| 6,030,465 | A | 2/2000 | Marcussen et al. | |
| 6,533,871 | B2 | 3/2003 | Zahuranec et al. | |
| 2003/0101532 | A1 * | 6/2003 | Desinger et al. | 15/321 |
| 2005/0091783 | A1 * | 5/2005 | Sepke et al. | 15/320 |

FOREIGN PATENT DOCUMENTS

| | | | |
|---|---|---|---|
| DE | 2361894 | * | 6/1975 |
| DE | 2703819 | * | 8/1978 |
| DE | 19502163 | * | 1/1995 |
| DE | 4111592 | * | 6/1995 |
| WO | WO 98/22011 | * | 5/1998 |

* cited by examiner

*Primary Examiner*—Terrence R. Till
(74) *Attorney, Agent, or Firm*—Amster, Rothstein & Ebenstein LLP

(57) ABSTRACT

A carpet extractor head for a carpet extractor including at least one sonic agitator. The at least one sonic agitator includes a beater portion and an actuating member that vibrates the beater portion. The beater portion includes a hollow roller.

26 Claims, 10 Drawing Sheets

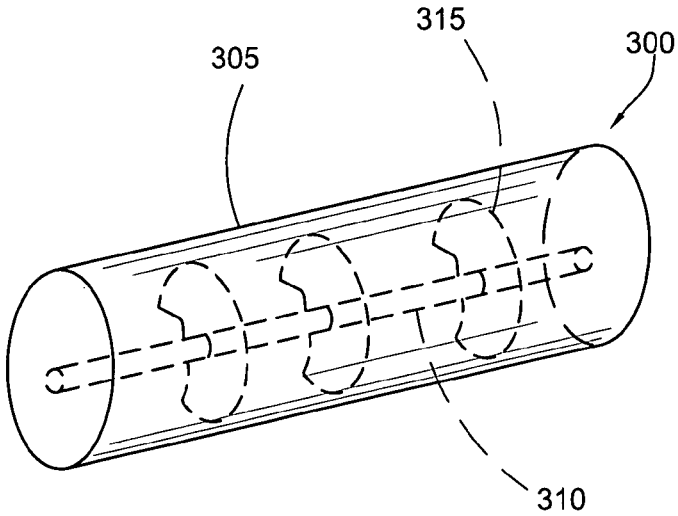
FIG. 10
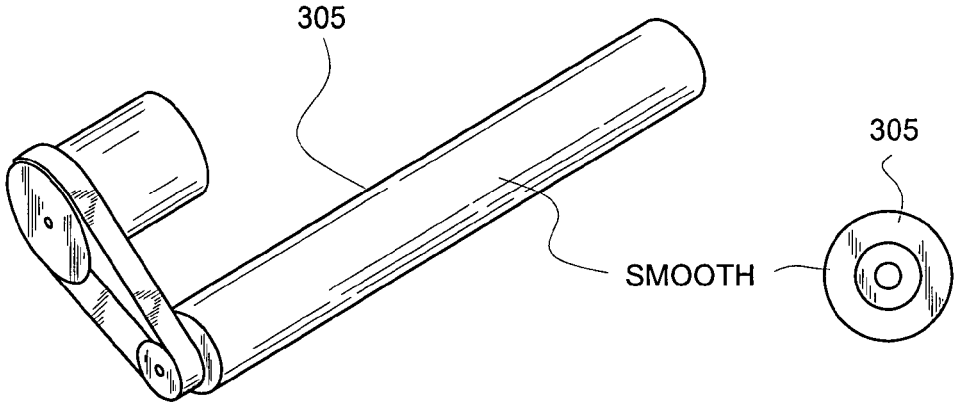
FIG. 11B
FIG. 11A

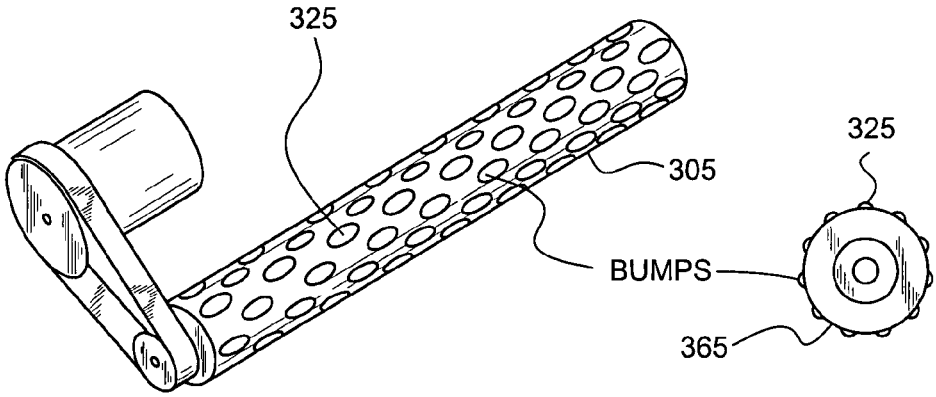
FIG. 12A
FIG. 12B
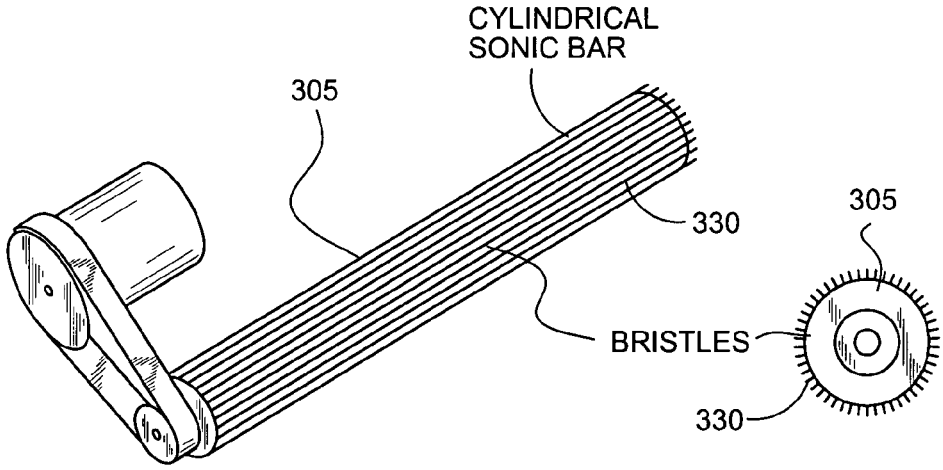
FIG. 13A
FIG. 13B

EXTRACTOR INCLUDING SONIC AGITATOR

RELATED APPLICATIONS

This application is a continuation-in-part of U.S. patent application Ser. No. 10/962,107, filed Oct. 8, 2004, the disclosure of which is incorporated herein by reference.

FIELD OF THE INVENTION

The present disclosure relates to extractors and, more particularly, to carpet extractors having agitators that assist in dislodging dirt from a surface to be cleaned.

BACKGROUND OF THE INVENTION

Extractors that use a liquid to clean a carpet, upholstery, or like surface are well known in the art. A conventional extractor generally includes a cleaning liquid or diluted detergent delivery system including a container for holding the cleaning liquid, a rotating agitator or a revolving scrubber for scrubbing the surface to be cleaned, and a gravity feed or pump for delivering the cleaning liquid to the surface. The conventional extractor also includes a cleaning liquid recovery system having a recovery nozzle, a suction generating device, such as a motor driven fan, and a dirty cleaning liquid recovery tank. Such extractors are more effective than typical vacuum cleaners due to their ability to loosen ground in dirt by the action of the rotating agitator or scrubbing brush in conjunction with application of the cleaning liquid.

A rotating agitator of an extractor is effective in loosening dirt on the surface of a carpet pile. However, such agitators are not as effective in removing particles embedded deeply in the carpet. Also, rotating agitators tend to push dirt particles down into the carpet, thereby making it more difficult to effectively clean the carpet. Accordingly, there is a need for an agitator construction for an extractor that can provide a more through cleaning action.

SUMMARY OF THE INVENTION

One aspect of this invention is to provide a carpet extractor head that allows a carpet extractor to exhibit an improved cleaning action.

Another aspect of this invention provides a carpet extractor head that allows for an improved cleaning action regardless of the direction in which a user pushes the vacuum cleaner nozzle.

Another aspect of this invention provides a carpet extractor head that thoroughly cleans surface fibers and deep fibers of a carpet by effectively dislodging dirt particles at all depths of the carpet pile.

Another aspect of this invention provides a carpet extractor head including a mechanical agitator that effectively removes imbedded dirt without driving dirt particles deeper into the surface to be cleaned.

A carpet extractor head according to an exemplary embodiment of the invention includes at least one sonic agitator. The at least one sonic agitator includes a beater portion and an actuating member that vibrates the beater portion. The beater portion includes a hollow roller.

A carpet extractor according to an exemplary embodiment of the invention includes a cleaning liquid delivery system that delivers cleaning liquid to a surface to be cleaned, a cleaning liquid recovery system that recovers dirty cleaning liquid and removes loosened dirt particles from the surface to be cleaned, and a carpet extractor head including at least one sonic agitator. The sonic agitator includes a beater portion and an actuating member that vibrates the beater portion. The beater portion includes a hollow roller In at least one embodiment, the extractor head further includes at least one mechanical agitator.

In at least one embodiment, the at least one sonic agitator includes a first sonic agitator and a second sonic agitator, and the first sonic agitator is disposed at one side of the at least one mechanical agitator and the second agitator is disposed at another side of the at least one mechanical agitator.

In at least one embodiment, the at least one mechanical agitator includes a rotatable brush roller.

In at least one embodiment, the at least one mechanical agitator includes a plurality of rotatable scrub brushes.

In at least one embodiment, the extractor head further includes a manifold that delivers cleaning liquid to a surface to be cleaned.

In at least one embodiment, the actuating member includes a shaft and at least one eccentric member disposed on the shaft.

In at least one embodiment, the hollow roller is disposed on the shaft, and the at least one eccentric member is disposed within the hollow roller.

In at least one embodiment, the hollow roller has an outer surface, and the outer surface is smooth In at least one embodiment, the hollow roller has an outer surface, and the outer surface is textured.

In at least one embodiment, a plurality of bumps extend from the outer surface of the hollow roller.

In at least one embodiment, the hollow roller has an outer surface, and a plurality of bristles are formed on the outer surface.

These and other features of this invention are described in, or are apparent from, the following detailed description of various exemplary embodiments of this invention.

BRIEF DESCRIPTION OF THE FIGURES

Various exemplary embodiments of the invention will be described in detail, with reference to the following figures, wherein:

FIG. 10 shows a sonic agitator according to another exemplary embodiment of the invention;

FIGS. 11A and 11B show a sonic agitator according to another exemplary embodiment of the invention;

FIGS. 12A and 12B show a sonic agitator according to another exemplary embodiment of the invention; and FIGS. 13A and 13B show a sonic agitator according to another exemplary embodiment of the invention.

DETAILED DESCRIPTION OF PREFERRED EMBODIMENTS

Various exemplary embodiments of the present invention relate to an extractor including at least one sonic agitator. For purposes of the present description, the term "sonic beater" refers to a beater that vibrates so as to transfer acoustic energy, and in some cases also mechanical energy, to the surface to be cleaned. When cleaning a carpet, a sonic beater preferably vibrates the carpet pile at the carpet pile's natural frequency to more effectively loosen embedded dirt. For example, the carpet pile may be vibrated at a frequency within a range of about 5,000 Hz to about 25,000 Hz. The sonic agitator assists in loosening embedded debris from the surface to be cleaned by working in conjunction with conventional mechanical agitators, such as brush rollers. For purposes of the present description, the term "mechanical beater" refers to a beater that relies on any type of energy, preferably mechanical energy, to loosen embedded dirt in the surface to be cleaned, except for acoustic energy. A mechanical beater used in conjunction with a sonic beater allows for a more effective cleaning action. For example, when cleaning carpet, the mechanical beater brush helps to loosen dirt located on the upper portion or surface of the carpet's pile while the sonic beater helps to loosen the embedded dirt located in the lower portion of the carpet's pile. Further, the use of both sonic and mechanical beaters can permit the use of softer bristles on a mechanical brush to reduce the wear and tear on the carpet caused by the rotating mechanical brush.

In the present disclosure, like reference numbers refer to like elements throughout the drawings, which illustrate various exemplary embodiments of the present invention.

Figure 1:
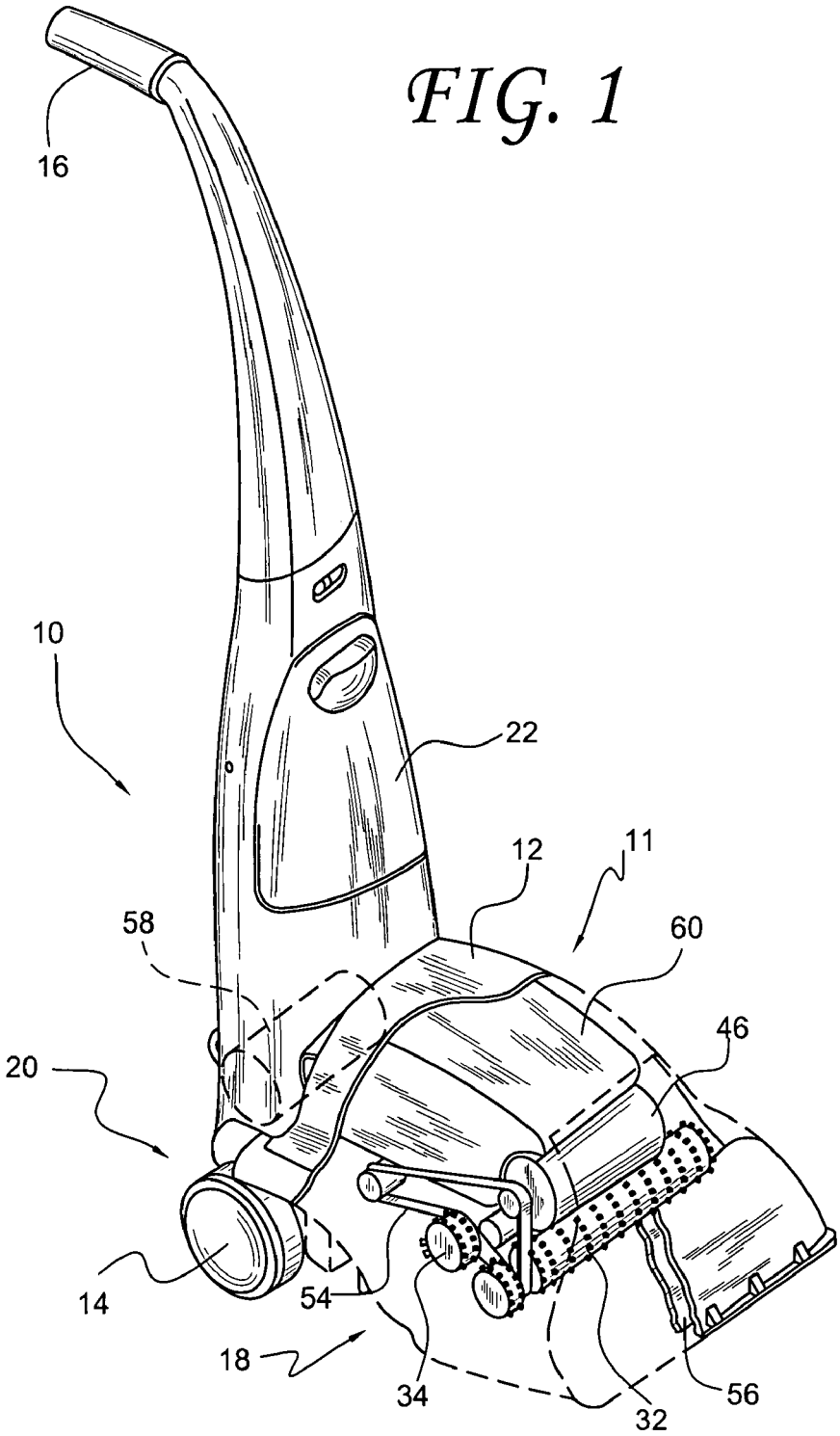
FIG. 1 shows an extractor according to an exemplary embodiment of the invention.

FIG. 1 generally shows an extractor 10 according to an exemplary embodiment of the present invention. The extractor 10 includes an extractor head 11 including a housing 12 supported for movement relative to the surface to be cleaned by a pair of wheels 14. A handle 16 is mounted to the housing 12 by a hinge assembly (not shown) in a manner well known in the art. The handle 16 allows for manipulation and control of the extractor 10.

Figure 2:
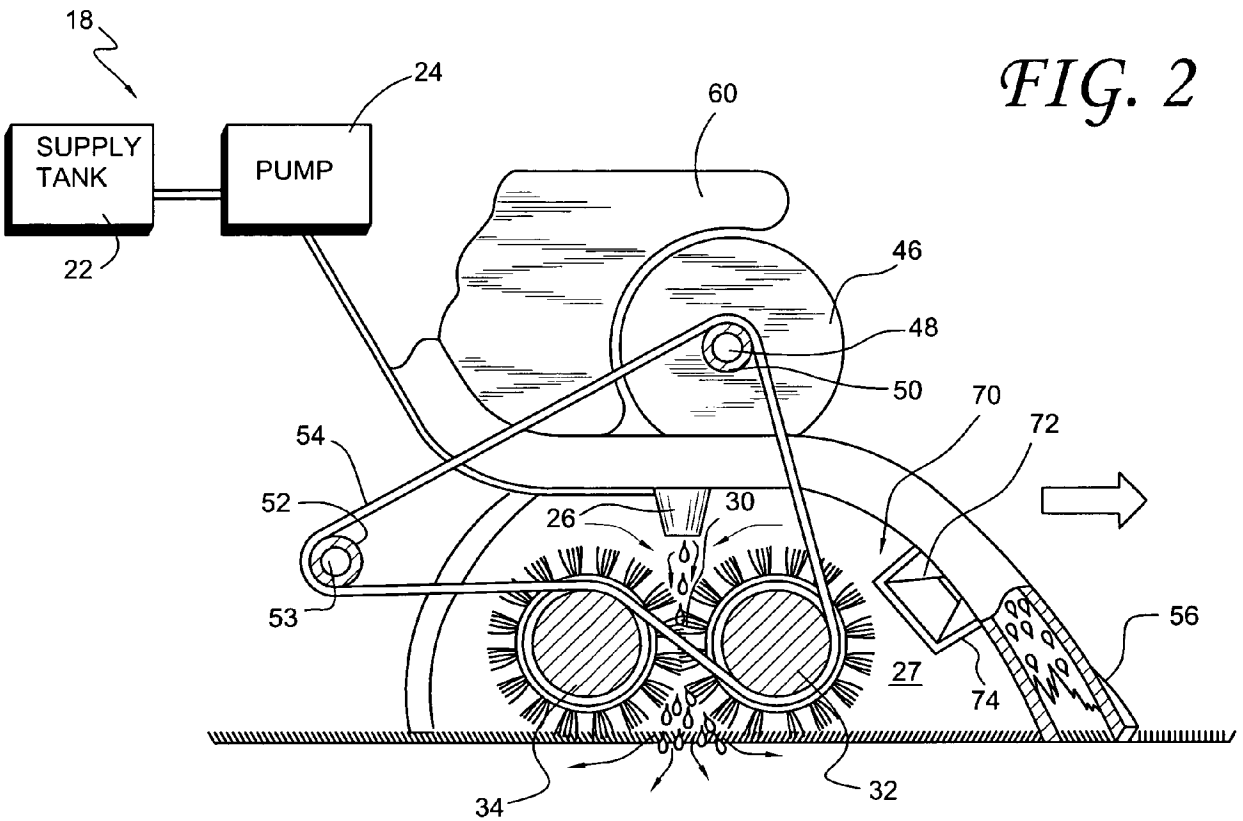
FIG. 2 is a side sectional view of an extractor head according to an exemplary embodiment of the invention.

The housing 12 carries a cleaning liquid delivery system, generally designated by reference numeral 18, and a cleaning liquid recovery system, generally designated by reference numeral 20. As shown in FIG. 2, which is a side sectional view of the extractor head 11, the cleaning liquid delivery system 18 includes a cleaning liquid supply tank 22 that may, for example, be mounted in the handle 16. The cleaning liquid may be any suitable cleaning composition known in the art, such as, for example, hot water or a mild detergent solution. Preferably, a pump 24 pumps cleaning liquid from the supply tank 22 to a manifold 26 positioned near the center of an agitator chamber 27 defined by the housing 12. The pump 24 may include its own electric drive motor or be driven by the agitator motor 46 or the motor of the vacuum fan and motor assembly 58 described below. Alternatively, a gravity feed line can be used instead of the pump 24.

Figure 3:
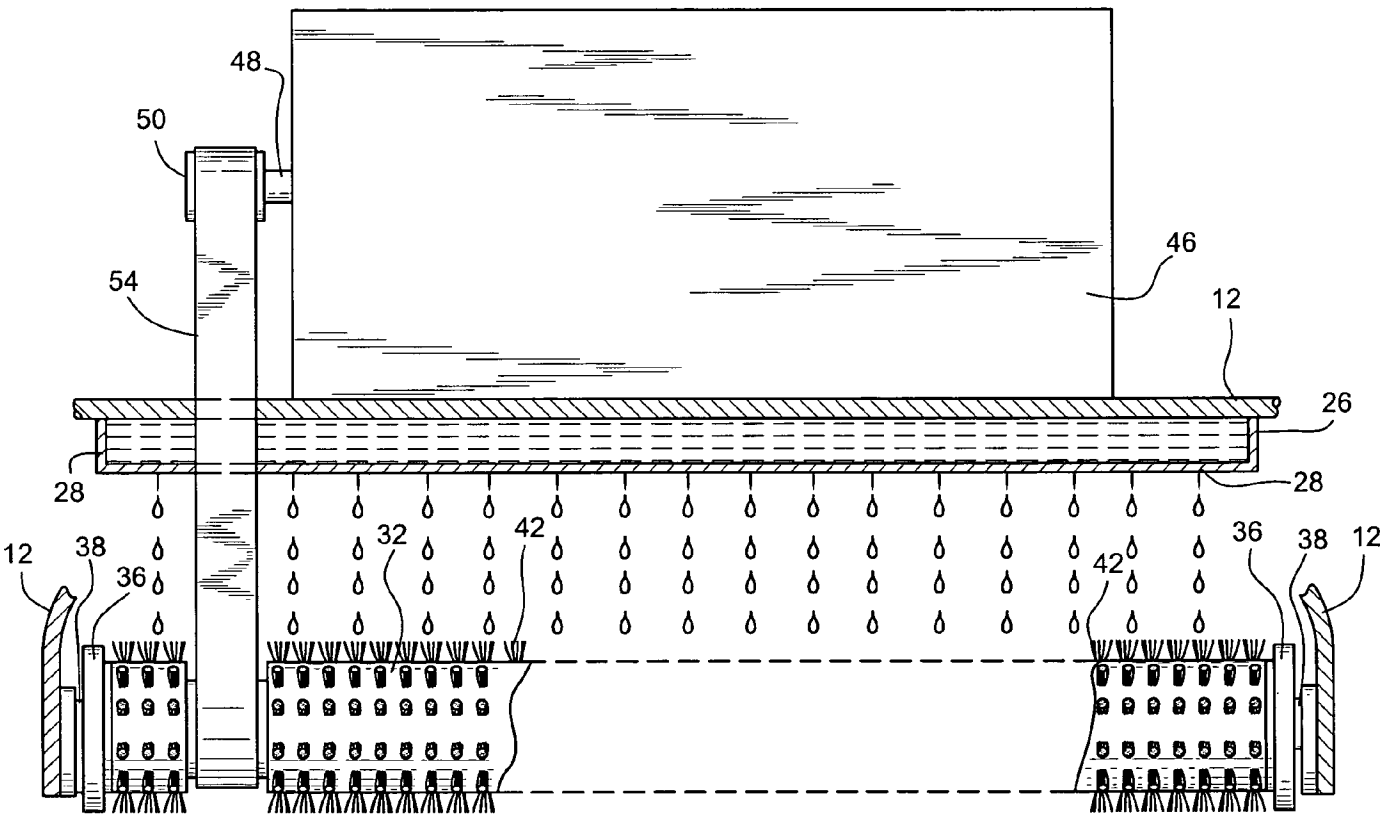
FIG. 3 is a front sectional view of an extractor head according to an exemplary embodiment of the invention.

As shown in FIG. 3, which is a front sectional view of the extractor head 11, the manifold 26 includes a longitudinal axis that extends across substantially the entire transverse dimension of the extractor 10. A series of delivery ports 28 are provided at spaced locations along the length of the manifold 26. The delivery ports 28 provide a substantially even distribution of cleaning liquid across the width of the extractor as the extractor is pushed over the carpet.

First and second mechanical agitators 32, 34 are disposed within the housing 12. In the present embodiment of the invention, the mechanical agitators 32, 34 are bristle brush rollers mounted for relative rotation with respect to the housing 12. Any style of bristle pattern may be used and the bristles 42 themselves may be directly tufted or inserted into each mechanical agitator 32, 34 or even carried by means of a replaceable strip attached to the body of each agitator 32, 34. Any other suitable mechanical agitator structure may be used, such as, for example, resilient wiper blades or a series of resilient projecting elastomeric fingers.

The mechanical agitators 32, 34 in the form of bristle brush rollers may be mounted in any manner well known to those skilled in the art. For example, each mechanical agitator 32, 34 may rotate on a shaft (not shown) bridging between and supported by bearings held by a pair of end caps 36. Each end cap 36 carries a lug 38 that is received in a mating slot in the housing 12. The mechanical agitators 32, 34 may be driven by a drive motor 46 mounted to the housing 12. The drive motor 46 includes a drive shaft 48 connected to a drive pulley 50. A drive belt 54 connects the drive pulley 50 to an idler pulley 52 and the first and second mechanical agitators 32, 34. The idler pulley 52 is carries for relative rotation by stub shaft 53 fixed to the housing 12. As shown in FIG. 2, drive belt 54 extends around the idler pulley 52 over the top of the second mechanical agitator 34 and around the bottom of the first mechanical agitator 32 before returning to the drive pulley 50. Thus, as the motor 46 is driven in the clockwise direction, the first and second mechanical agitators 32, 34 are driven in counterrotating directions.

The cleaning liquid recovery system 20 includes a recovery nozzle 56 carried at the front of the housing 12 adjacent to the first mechanical agitator 32. The first mechanical agitator 32 is rotated in a direction toward the recovery nozzle 56, which aids in the efficient recovery and extraction of cleaning liquid and associated entrained dirt and soil from the carpet being cleaned.

The nozzle 56 is in communication with a vacuum generator such as a fan and motor assembly 58 carried in the housing. More specifically, cleaning liquid and entrained soil and dirt are extracted from the carpet being cleaned and drawn through the nozzle 56 by the fan and motor assembly 58 to a dirty liquid recovery tank 60. This recovery tank 60 is equipped with any of a number of filtering systems of a type well known in the art for separating the air from the cleaning liquid whereby the cleaning liquid is trapped and maintained in the recovery tank 60 and the air is exhausted into the environment.

Figure 4:
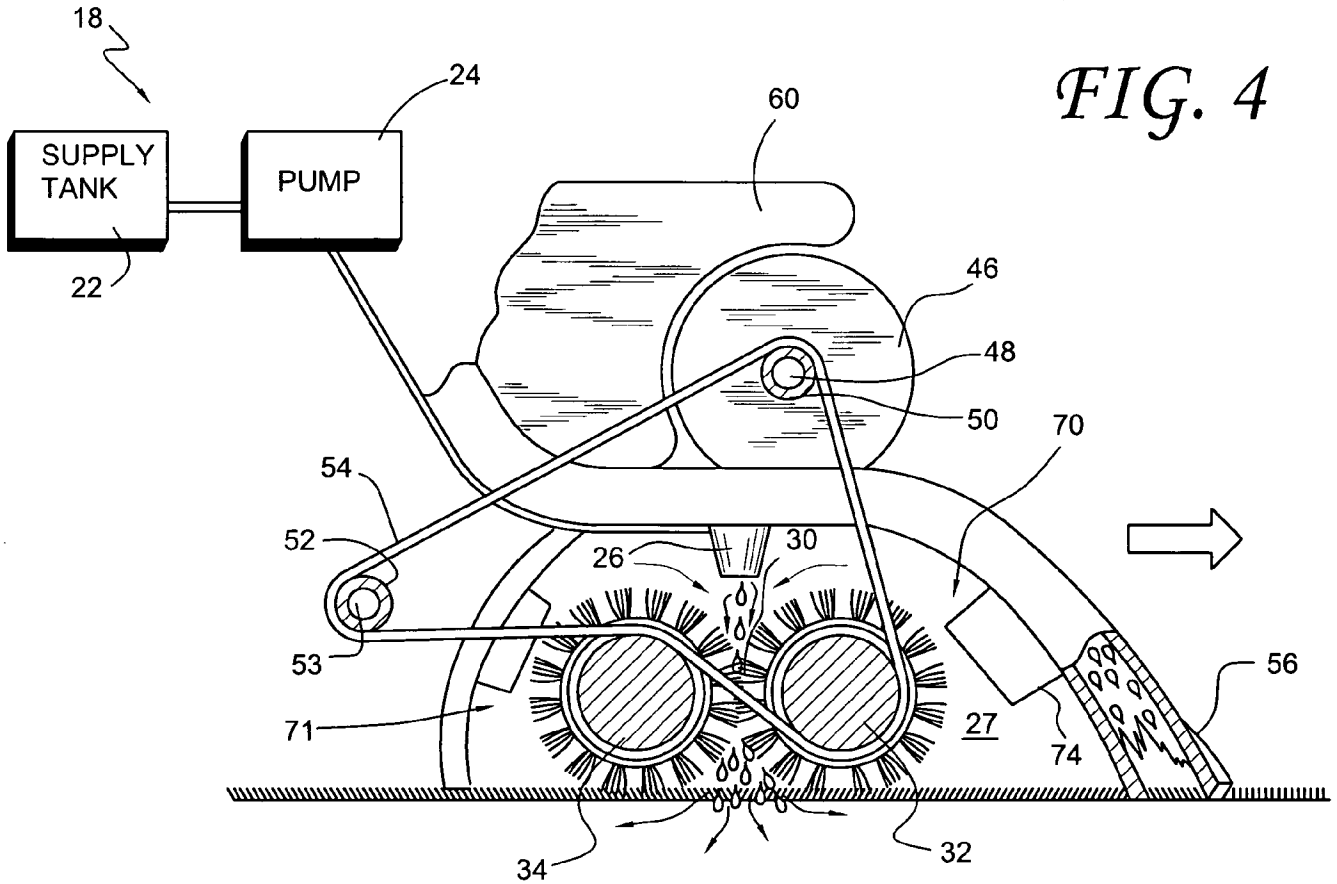
FIG. 4 is a side sectional view of an extractor head according to another exemplary embodiment of the invention.

In addition to the mechanical agitators 32, 34, a sonic agitator generally designated by reference numeral 70 is disposed in the housing 12. Although the sonic agitator 70 is shown attached to the housing 12 in front of the mechanical agitators 32, 34, it should be appreciated that the sonic agitator 70 can be disposed behind the mechanical agitators 32, 34. Further, as shown in FIG. 4, which is a side sectional view of an extractor head according to another exemplary embodiment of the invention, a sonic agitator 70 may be disposed at the front of the mechanical agitators 32, 34 and another sonic agitator 71 may be disposed behind the mechanical agitators 32, 34. As will be come more apparent below, such an arrangement of sonic agitators will allow the extractor 10 to effectively loosen and suck up embedded dirt regardless of the direction of movement of the housing 12. The sonic agitator 70 may be any suitable agitator that effectively vibrates the surface to be cleaned without substantially contacting the surface, so that ground-in dirt can be dislodged without driving the dirt deeper into the carpet pile.

The sonic agitator 70 in the present embodiment of the invention is a speaker 72. The speaker 72 is preferably housed in and attached to the housing 12 by a speaker housing 74. The speaker housing 74 is preferably made of an acoustically transparent material substantially impervious to dirt and fluid so as to seal speaker 72 from the debris sucked up by the extractor 10. The speaker housing may be made of, for example, polypropylene. Speaker 72 is preferably a solid state power circuit including a frequency generator and an amplifier capable of producing up to, for example, 100 watts of power. The speaker 72 may be tuned to emit sound waves at a frequency in a range of about 200 hertz to about 500 hertz. Within such a frequency range, the speaker 72 will be effective in loosening dirt embedded within carpet and also within hard surfaces, such as wood or tile flooring.

The speaker 72 may include amplitude and/or frequency control knobs disposed at a location that is accessible to a user, such as on the top of the housing 12. The user may then have the ability to adjust the amplitude and/or frequency of the speaker 72 to a level at which the extractor 10 is most effective in loosening ground in dirt.

Figure 5:
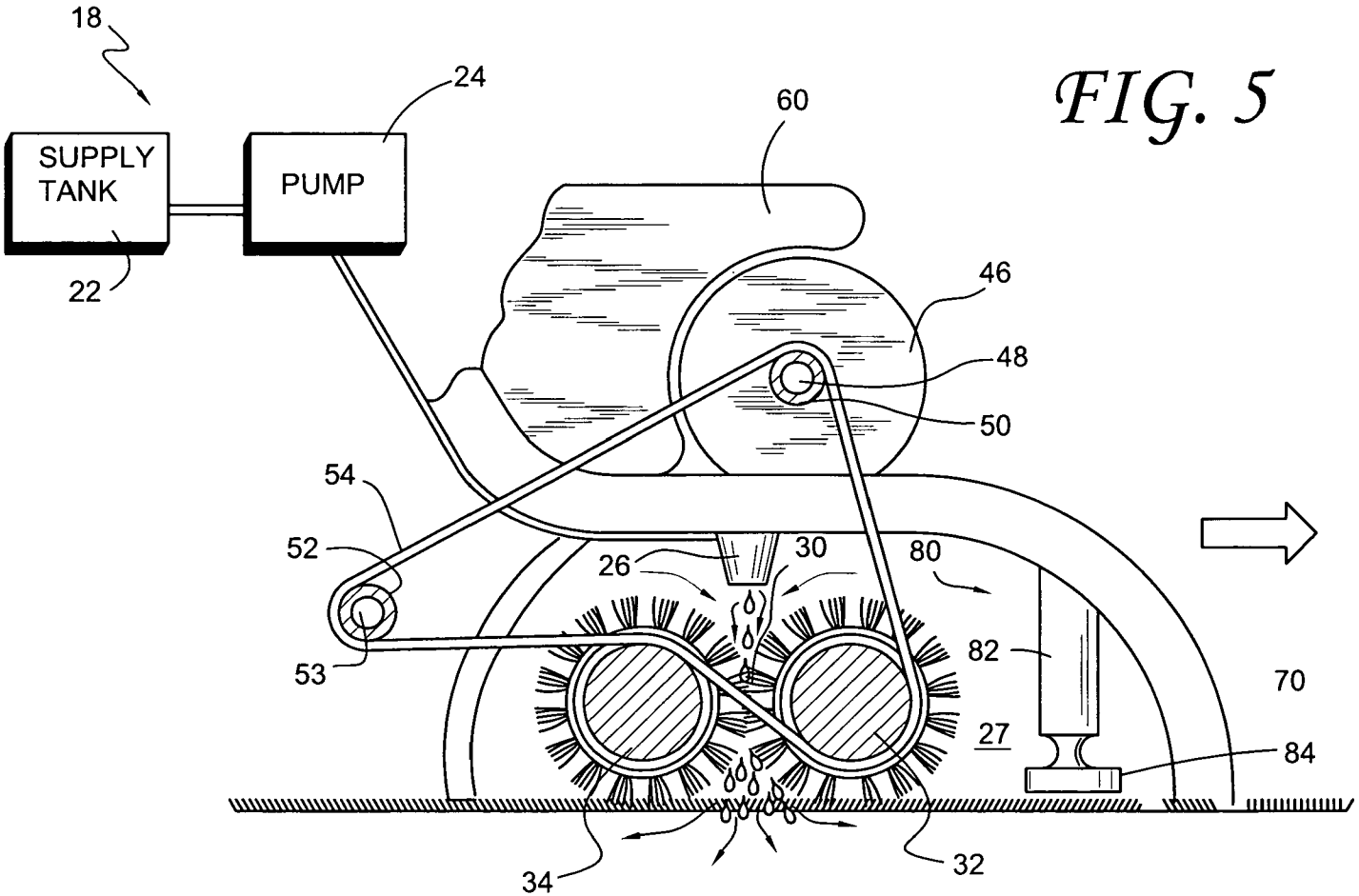
FIG. 5 is a side sectional view of an extractor head according to another exemplary embodiment of the invention.
Figure 6:
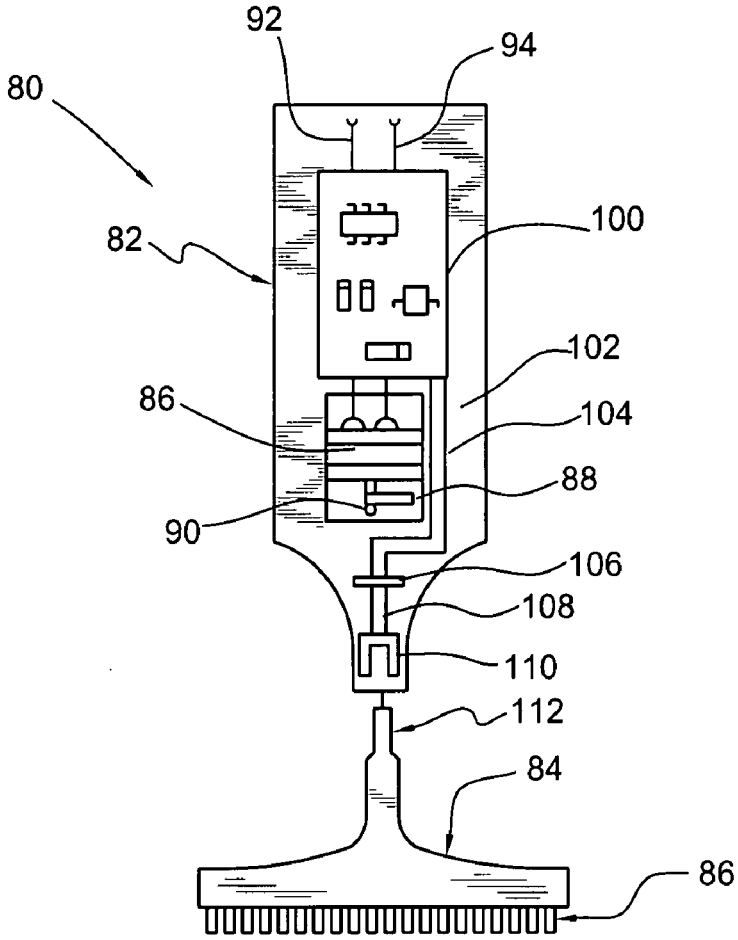
FIG. 6 is a vertical sectional view of a sonic agitator used in the extractor head of FIG. 5.

It should be appreciated that the sonic agitator 70 is not limited to a speaker-type system. For example, FIG. 5 shows a side sectional view of an extractor head 11 in which the sonic agitator 70 is in the form of a sonic beater that contacts and vibrates the surface to be cleaned at a rapid rate to pre-loosen ground in dirt so as to enhance the effectiveness of the first and second agitators 32, 34. The sonic beater 80 includes an ultrasonic actuating member 82 and a brush head 84. As shown more clearly in FIG. 6, which is a vertical sectional view of the sonic beater 80, the brush head 84 includes a bristled end 86. The brush head 84 is set at a predetermined level so that the bristled end 86 will barely contact the surface to be cleaned while extractor 10 is in operation. The ultrasonic actuating member 82 includes an electric motor 86 to which is attached an eccentrically mounted member 88 via a rotatable shaft 90. The electric motor 86 is connected to a power source (not shown) via electrical conductors 92 and 94. When the extractor 10 is turned on, the electric motor 86 will rotate eccentric member 88 and the entire sonic beater 80 will vibrate in a rotary direction. Because the ultrasonic actuating member 82 is fixed to the extractor head 11 and the mass of the ultrasonic actuating member 82 is much greater than that of the brush head 84, the bristled end 86 of the brush head 84 will vibrate about a greater radius than that of the ultrasonic actuating member 82. Thus, the bristled end 86 will rotate at a rapid rate.

Also connected to the power source is an electronic circuit package 100 that produces high frequency oscillations which are coupled via lines 102 and 104 to an ultrasonic transducer 106. The transducer 106 is in turn mechanically coupled via connector 108 to a holder 110 which is adapted to surround and frictionally secure within it an extension 112 of the brush head 84. The ultrasonic transducer 106 is preferably a commercially available device capable of producing an ultrasonic wave in the frequency range of, for example, 10–20 MHz. The energy is coupled directly from the transducer 106 through the connector 108 which acts as a wave guide and into holder 110 from which it propagates into the brush head 84. Thus, the bristled end 86 of the brush head 84 vibrates ultrasonically while being caused to rotate by the rotating eccentric member 88. This rapid motion of the brush head 84 sonically agitates the dirt embedded in the surface to be cleaned, and therefore pre-loosens the dirt before the agitators 32, 34 pass over the surface. Also, because the bristled end 86 of the brush head 84 barely contacts the surface, the brush head 86 is able to agitate the dirt without grounding the dirt into the carpet.

Figure 7:
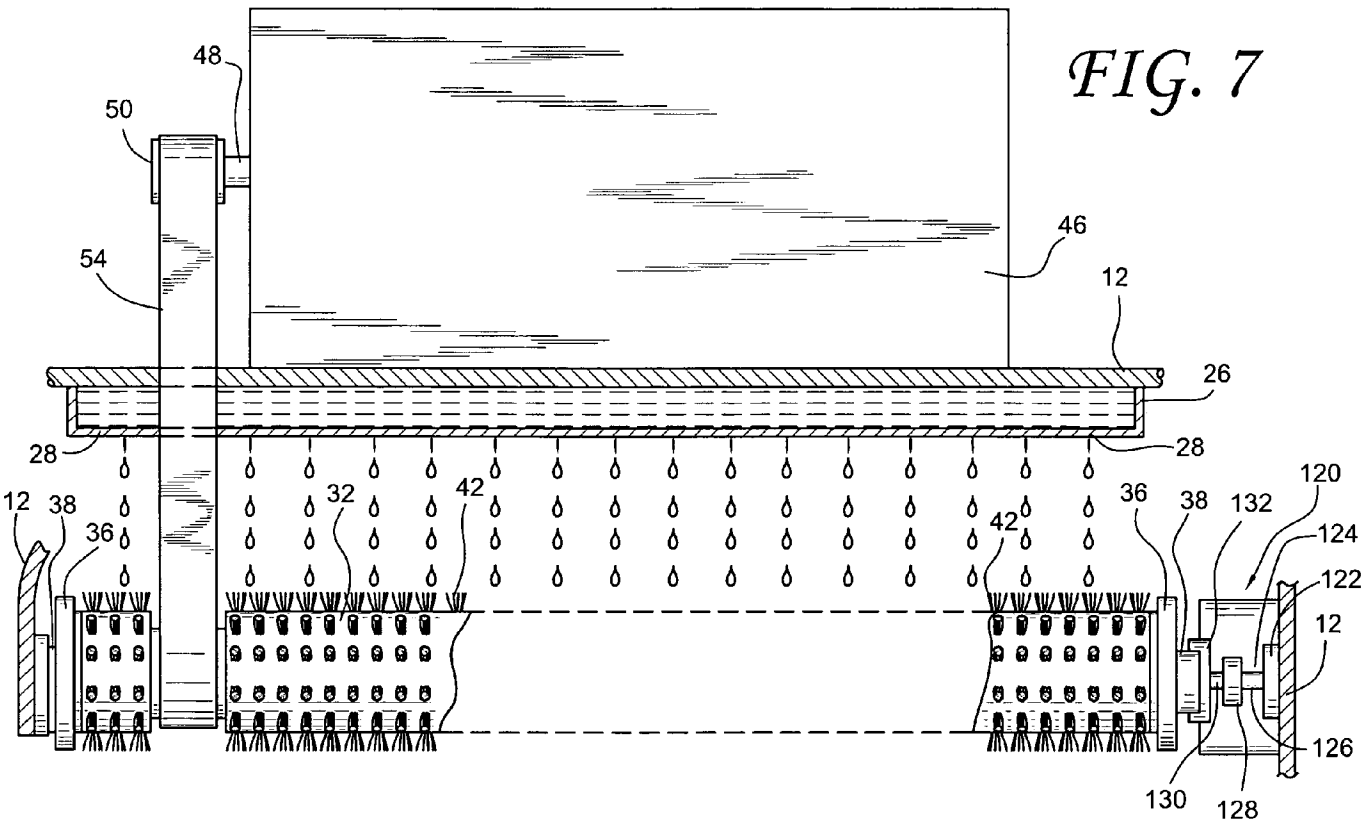
FIG. 7 is a front sectional view of an extractor head according to another exemplary embodiment of the invention.

FIG. 7 shows a front sectional view of an extractor head according to another exemplary embodiment of the invention. The present embodiment of the invention is substantially the same as the previous embodiment except that the sonic agitation used to loosen embedded dirt is caused by rapidly vibrating the agitators 32, 34, rather than by using a separate sonic agitator, such as the speaker 72 or the sonic beater 80. As in the previous embodiment, the extractor head 11 generally includes a cleaning liquid delivery system 18 and a cleaning liquid recovery system 20. First and second agitators 32, 34 are disposed within the housing 12. In the present embodiment of the invention, the agitators 32, 34 are bristle brush rollers mounted for relative rotation with respect to the housing 12. Any style of bristle pattern may be used and the bristles 42 themselves may be directly tufted or inserted into each agitator 32, 34 or even carried by means of a replaceable strip attached to the body of each agitator 32, 34.

As in the previous embodiment, each agitator 32, 34 may rotate on a shaft (not shown) bridging between and supported by bearings held by a pair of end caps 36. As described in further detail below, the end cap 36 of at least one of the agitators 32, 34 carries a lug 38 that is received in a mating holder of an ultrasonic actuator 120 carried by the housing 12. The agitators 32, 34 may be driven by a drive motor 46 mounted to the housing 12. The drive motor 46 includes a drive shaft 48 connected to a drive pulley 50. A drive belt 54 connects the drive pulley 50 to an idler pulley 52 and the first and second agitators 32, 34. The idler pulley 52 is carries for relative rotation by stub shaft 53 fixed to the housing 12. As shown in FIG. 2, drive belt 54 extends around the idler pulley 52 over the top of the second agitator 34 and around the bottom of the first agitator 32 before returning to the drive pulley 50. Thus, as the motor 46 is driven in the clockwise direction, the first and second agitators 32, 34 are driven in counterrotating directions.

The ultrasonic actuator 120 is mounted to the housing 12 and is operatively engaged with the shaft of the first agitator 32 via the lug 38. The ultrasonic actuator 120 includes an electronic circuit package 122 that produces high frequency oscillations which are coupled via lines 124 and 126 to an ultrasonic transducer 128. The transducer 128 in turn is mechanically coupled via connector 130 to a holder 132 which is adapted to surround and frictionally secure within it the lug 38. Thus, the ultrasonic waves caused by the transducer 128 are imparted to the lug 38, which in turn causes the first agitator 32 to rapidly vibrate while rolling over the surface to be cleaned. This enhances the effectiveness of the first agitator 32 by allowing it to agitate and loosen embedded dirt without pushing the dirt further into the carpet.

It should be appreciated that both the first and second agitators 32, 34 may be operatively connected with a corresponding ultrasonic actuator, so that both agitators 32, 34 are able to rapidly vibrate while rolling across a surface. Also, the extractor head 11 may include a sonic agitator 70 disposed in the housing 12 in addition to the ultrasonic actuator 120 to improve the effectiveness of the extractor 10 in loosening and removing embedded dirt particles. For example, in other exemplary embodiments of the invention, the speaker 72 and/or the sonic beater 80 may be used in conjunction with the ultrasonic actuator 120.

Figure 8:
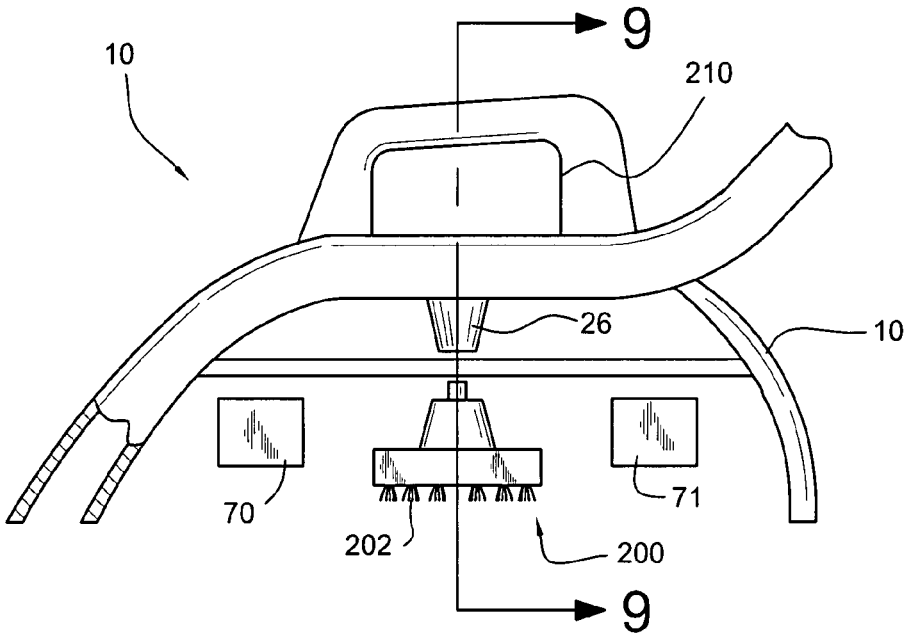
FIG. 8 shows an extractor according to another exemplary embodiment of the invention.
Figure 9:
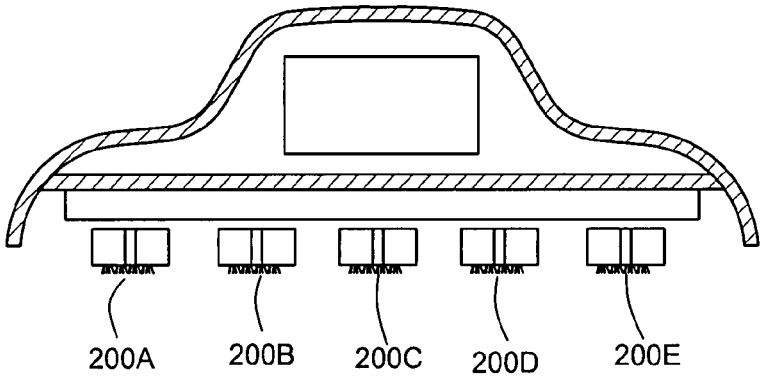
FIG. 9 is a sectional view taken along the line 9—9 of FIG. 8.

FIG. 8 is a side sectional view of an extractor head according to another exemplary embodiment of the invention, and FIG. 9 is a sectional view taken along the line A–A' of FIG. 8. The extractor head according to the present embodiment is essentially the same as the embodiment shown in FIG. 4 except that the mechanical agitators are round scrub brushes. Specifically, the extractor 10 according to the present embodiment of the invention includes a scrub brush assembly 200 suspended in the housing 12. Scrub brush assembly includes a plurality of scrub brushes 200A–22E that extend across the bottom of the housing 12 of the extractor 10. A plurality of bristles 202 is disposed around the bottom of each of the scrub brushes 200A–200E. The scrub brushes 200A–200E are driven so as to rotate as the extractor 10 is pushed across a surface to be cleaned. Any suitable drive means known in the art may be used to drive the scrub brushes 200A–200E, such as, for example, an air driven turbine 210 through a suitable gear drive train or transmission (not shown). The scrub brushes 200A–200E may all be driven in the same direction, or they may be alternately driven in clockwise and counter-clockwise directions to enhance the scrubbing action. A manifold 26 delivers cleaning liquid to each of the scrub brushes 200A–200E and the cleaning liquid is released onto the carpet surface through openings 204A–204E at the bottom of the scrub brushes 200A–200E.

As in previous embodiments of the invention, a sonic agitator may be disposed at both or either side of the scrub brush. For example, FIG. 8 shows a first sonic agitator 70 disposed at one side of the scrub brush assembly 200 and a second sonic agitator 71 disposed at another side of the scrub brush assembly 200. The first and second sonic agitators 70, 71 may be any of the sonic agitators previous described, such as a speaker or a sonic beater, or any other known or later discovered sonic agitator. Alternatively, each of the scrub brushes 200A–200E may be actuated to sonically vibrate as they rotate, so that separate sonic agitators are not needed.

In other exemplary embodiments of the invention, the sonic agitator disposed in the extractor head 11 includes a cylindrical roller that also vibrates as it rolls across the surface to be cleaned. For example, FIG. 10 shows a sonic agitator 300 including a hollow roller 305 disposed on a shaft 310. Eccentric member 315 are disposed on the shaft 310 within the hollow roller 305. Although four eccentric members 315 are shown in FIG. 10, the shaft 310 may include any number of eccentric members 315 depending on the desired intensity of vibration. As shown in FIG. 11A, a motor 320 and pulley 325 arrangement may be used to drive the shaft 310. The motor 320 may be the same motor used to drive the mechanical beater, such as the previously described motor 46, or may be a separate motor. While turning, the eccentric member 315 causes the shaft 310 to vibrate, which in turn causes the hollow roller 305 disposed on the shaft 310 to vibrate and sonically agitate the carpet. The sonic agitator 300 including the hollow roller 305 may be used in conjunction with a mechanical beater, such as the previously described bristle brush rollers or scrub brushes. Further, more than one vibrating hollow roller 305 may be used in the extractor head 11 to enhance agitation of ground-in dirt.

As shown in FIGS. 11A and 11B, the hollow roller 305 may have a smooth outer surface. However, in other embodiments of the invention, the hollow roller 305 may have a textured surface. For example, as shown in FIGS. 12A and 12B, a plurality of bumps 325 may be formed on the outer surface of the hollow roller 305. Alternatively, as shown in FIGS. 13A and 13B, a pattern of bristles 330 may be formed on the outer surface of the hollow roller 305. Disposing bristles on or otherwise texturing the outer surface of the hollow roller 305 increases the agitation of the carpet, thereby more effectively loosening the in-grained dirt.

It should be appreciated that the present invention is intended to encompass any combination of mechanical and sonic agitators in an extractor head of a carpet extractor, where the mechanical agitators and/or the sonic agitators are caused to sonically agitate the surface to be cleaned. The present invention is intended to also encompass extractors that do not include mechanical agitators, but instead use suction action in conjunction with one or more sonic actuators to loosen and remove dirt. Such extractors would have little or no agitator contact with the surface to be cleaned, which may be advantageous when cleaning delicate surfaces, such as antique rugs.

While the foregoing invention has been described in some detail for purposes of clarity and understanding, it will be appreciated by one skilled in the art from a reading of the disclosure that various changes in form and detail can be made without departing from the true scope of the invention in the appended claims.

What is claimed is:

1. A carpet extractor head comprising at least one sonic agitator, the sonic agitator comprising a beater portion and an actuating member that vibrates the beater portion, the beater portion comprising a rotatable hollow roller.

2. The carpet extractor head of claim 1, further comprising at least one mechanical agitator.

3. The carpet extractor head of claim 2, wherein the at least one sonic agitator comprises a first sonic agitator and a second sonic agitator, the first sonic agitator being disposed at one side of the at least one mechanical agitator and the second agitator being disposed at another side of the at least one mechanical agitator.

4. The carpet extractor head of claim 2, wherein the at least one mechanical agitator comprises a rotatable brush roller.

5. The carpet extractor head of claim 2, wherein the at least one mechanical agitator comprises a plurality of rotatable scrub brushes.

6. The carpet extractor head of claim 1, further comprising a manifold that delivers cleaning liquid to a surface to be cleaned.

7. The carpet extractor head of claim 1, wherein the actuating member comprises:

a shaft; and at least one eccentric member disposed on the shaft.

8. The carpet extractor head of claim 7, wherein the hollow roller is disposed on the shaft, and the at least one eccentric member is disposed within the hollow roller.

9. The carpet extractor head of claim 8, wherein the hollow roller has an outer surface, and the outer surface is smooth.

10. The carpet extractor head of claim 8, wherein the hollow roller has an outer surface, and the outer surface is textured.

11. The carpet extractor head of claim 10, wherein a plurality of bumps extend from the outer surface of the hollow roller.

12. The carpet extractor head of claim 8, wherein the hollow roller has an outer surface, and a plurality of bristles are formed on the outer surface.

13. A carpet extractor comprising the carpet extractor head of claim 1.

14. A carpet extractor comprising:

a cleaning liquid delivery system that delivers cleaning liquid to a surface to be cleaned;

a cleaning liquid recovery system that recovers dirty cleaning liquid and removes loosened dirt particles from the surface to be cleaned; and a carpet extractor head comprising at least one sonic agitator, the sonic agitator comprising a beater portion and an actuating member that vibrates the beater portion, the beater portion comprising a hollow roller.

15. The carpet extractor of claim 14, wherein the cleaning liquid delivery system comprises:

a cleaning liquid supply tank;

a manifold disposed in the carpet extractor head that distributes cleaning liquid to the surface to be cleaned; and a pump that delivers cleaning liquid from the cleaning liquid supply tank to the manifold.

16. The carpet extractor head of claim 14, wherein the cleaning liquid recovery system comprises:

a dirty liquid recovery tank disposed in the carpet extractor head; and a recovery nozzle in the carpet extractor head that delivers dirty liquid and dirt particles to the dirty liquid recovery tank.

17. The carpet extractor of claim 14, further comprising at least one mechanical agitator.

18. The carpet extractor of claim 17, wherein the at least one sonic agitator comprises a first sonic agitator and a second sonic agitator, the first sonic agitator being disposed at one side of the at least one mechanical agitator and the second agitator being disposed at another side of the at least one mechanical agitator.

19. The carpet extractor of claim 17, wherein the at least one mechanical agitator comprises a rotatable brush roller.

20. The carpet extractor of claim 17, wherein the at least one mechanical agitator comprises a plurality of rotatable scrub brushes.

21. The carpet extractor of claim 14, wherein the actuating member comprises:

a shaft; and at least one eccentric member disposed on the shaft.

22. The carpet extractor of claim 21, wherein the hollow roller is disposed on the shaft, and the at least one eccentric member is disposed within the hollow roller.

23. The carpet extractor of claim 22, wherein the hollow roller has an outer surface, and the outer surface is smooth.

24. The carpet extractor of claim 22, wherein the hollow roller has an outer surface, and the outer surface is textured.

25. The carpet extractor of claim 24, wherein a plurality of bumps extend from the outer surface of the hollow roller.

26. The carpet extractor of claim 22, wherein the hollow roller has an outer surface, and a plurality of bristles are formed on the outer surface.

* * * * *